US006320109B1

(12) United States Patent
Küppers

(10) Patent No.: US 6,320,109 B1
(45) **Date of Patent: *Nov. 20, 2001**

(54) TRIPLE HI-HAT WITH A SIMPLE OPERATING DEVICE

(76) Inventor: Peter Küppers, Kaiserstiege 143, Gronau (DE), D-48599

( * ) Notice: Subject to any disclaimer, the term of this patent is extended or adjusted under 35 U.S.C. 154(b) by 0 days.

This patent is subject to a terminal disclaimer.

(21) Appl. No.: 09/647,177

(22) PCT Filed: Mar. 26, 1999

(86) PCT No.: PCT/DE99/00928

§ 371 Date: Oct. 19, 2000

§ 102(e) Date: Oct. 19, 2000

(87) PCT Pub. No.: WO99/49451

PCT Pub. Date: Sep. 30, 1999

(30) Foreign Application Priority Data

Mar. 27, 1998 (DE) ..... 198 13 610
Sep. 30, 1998 (DE) ..... 198 44 794

(51) Int. Cl.[7] ..... G10D 13/02
(52) U.S. Cl. ..... 84/422.3; 84/422.1; 84/422.2
(58) Field of Search ..... 84/422.3, 422.1, 84/422.2

(56) References Cited

U.S. PATENT DOCUMENTS 4,111,095 * 9/1978 Simons ..... 84/422.3
4,177,709 * 12/1979 Adams ..... 84/622.3
4,253,657 * 3/1981 Rozzelle ..... 472/64
4,274,322 * 6/1981 Cordes ..... 84/422.3

FOREIGN PATENT DOCUMENTS 11-143458 * 5/1999 (JP) .
1001515 * 7/1997 (NL) .

OTHER PUBLICATIONS

C. Bruno & Son Inc., Aug. 23, 1965.*

* cited by examiner

*Primary Examiner*—Shih-Yung Hsieh
(74) *Attorney, Agent, or Firm*—James Creighton Wray; Meera P. Narasimhan

(57) ABSTRACT

A hi-hat (1) is used as an instrument, especially as a percussion instrument. The inventive hi-hat consists of a set of in total three or more cymbals (2, 3, 4). An upper mobile cymbal (2) and a lower, also mobile cymbal (4) are struck against the middle, stationary cymbal (4) by means of a common operating device (5), in order to produce a noise. The movement of the pedal (31) is reversed by means of either an appropriate pneumatic arrangement with a piston (8) and corresponding cylinder chambers (10, 23) or a mechanical device which diverts the pedal movement via a cable (50) and a deflection pulley (51) so that the outer tube (14) moves upwards against the middle cymbal (3) whilst the rod (7) is pulled downwards in the opposite direction, hereby causing the upper cymbal (2) to strike the middle cymbal (3).

24 Claims, 9 Drawing Sheets

2
3
4
6
54
14
6
1
7
53
49
51
59
55
57
58
52
60
50
5

TRIPLE HI-HAT WITH A SIMPLE OPERATING DEVICE

BACKGROUND OF THE INVENTION

The invention relates to a hi-hat percussion instrument for generating sounds by causing cymbals to come together, with one cymbal being attached to a fixed tube and the other cymbal being mounted on a bar that moves up and down and is caused to move by means of an operating device.

During musical performances, in addition to various drums and kettledrums, use is made of convex cymbal plates or cymbals. Individual or several cymbals can be used as percussion instruments, and they are hit with sticks or other appropriate devices to generate a sound. The cymbals can be caused to strike each other, and in this case two cymbals, preferably of the same size, are used to come together at their rims. At the time of such strike, the cymbals, which are preferably made of metal, oscillate, and, as a result, an especially long sound is generated. So-called hi-hats belong to standard percussion equipment. The main components of such instruments are two cymbals, which are caused to come together under a pedal control when the sound is generated in such a manner as to touch each other at their rims. Generally, the upper cymbal is movable, and the lower cymbal is fixed. When the pedal is moved, a bar, which is mounted at the lower end of the pedal by means of a spring and has its upper end attached to the upper cymbal, moves down inside a tube. The upper cymbal strikes the oppositely mounted cymbal that is attached to the tube. This results in generation of a typically metallic long-sustained sound. During concerts, as well as during recording on a sound carrier in a studio, hi-hats are used as rhythmic instruments, which are generally operated in a timely fashion the percussion instruments with the foot control. The other foot is likewise used for a bass drum.

There is a problem that with a single operating device, normally a pedal, only single strikes of maximum two cymbals can be performed. The footwork of the drummer is normally limited to the operating of the bass drum with one foot and to the bringing together the two cymbals while generating one sound with the other foot. In the best case, the variation capabilities reside in the fact that cymbals of different size can be used to generate different sounds. During a concert, a plurality of such hi-hats can be played by several persons simultaneously in order to generate an intensive or saturated sound. Certain effects, e.g., two offset sounds cannot be realized with the state-of-the art instruments. It can be achieved by using modern techniques during a studio recording session by receiving the sound through a plurality of channels in order to obtain a reach or offset sound. However, this requires high technology and take time, and such results cannot be accomplished during a live concert.

SUMMARY OF THE INVENTION

The invention is based on the problem of providing an instrument that would allow for improving sound quality with various tuning capabilities.

This problem is solved by the fact that the cymbals are provided with at least one more cymbal that is movable up and down, which can be operated by the operating device with the movable cymbal or independently thereof and which can be caused to come together with, and to strike the fixed cymbal and/or the other cymbal.

Such hi-hat can be referred to as a triple hi-hat, in which at least three cymbals are available that can be caused to come together with the middle cymbal or with each other for striking each other. This gives an enormous variety of additional sounds, which could not be achieved with prior art hi-hats. This also assures an obvious improvement of the play capabilities, and the operating device, which is partly based on the known devices that assure the movement of the upper cymbal to the fixed cymbal, allows for tuning, which will be described below. Other solutions are also possible, and, among other things, a purely hand operated operating device can be used, with both movable cymbals being moved to the fixed cymbal. Such operating device certainly does not meet today's requirements, and pneumatic and mechanical operating devices could still be used as described below.

According to one preferred embodiment, one more cymbal that is provided under the fixed cymbal is mounted on an outer tube which is movable by the operating device and which is surrounded by a fixed tube. Now, with the help of the operating device, with the same operating direction, the upper cymbal is moved to the middle cymbal and, at the same time, the lower cymbal is moved to the middle cymbal and strikes it. The direction of movement of the upper cymbal movable bar will now be explained in detail.

In the most preferred embodiment of a mechanical operating device for the triple hi-hat described herein, in which the bar is pivotally connected to a known pedal acts which upon a cable tie connected to the outer tube, with the cable tie, which is guided by a deflection roller, being attached to the outer tube. As will be explained below, it is possible, with the operating device of this type, that the upper cymbal will move down to the middle cymbal and, at the same time, the lower cymbal will move up to the middle cymbal. With this operating device, it is possible to assure that all three cymbals will come together at the same time, or they can come together with a predetermined time shift, which is exactly needed for the drummer. It is important that he uses one and the same pedal movement both for moving the bar down and, at the same time, to move the outer tube up through the cable tie and the deflection roller. Only one pedal is required for operating both movable cymbals, so the other foot can be used for operating other instruments, or it can rest.

The up and down moving bar and the cable tie that moves respectively can be moved by one and the same "foot" of the hi-hat, and the invention provides that the bar can be composite and can comprise a pedal part, a sleeve part, and a cymbal bar, with the pedal part being made as a tube supporting the deflection roller for the cable tie, and the attached sleeve part being made as an intermediate bar, which surrounds the deflection roller and connects to the cymbal bar. In this case, no through-going bar is used, and the mechanical system assures simultaneously the movement of the cable tie and its deflection over the deflection roller, whereby the downward movement of the bar can be transformed into the upward movement of the outer tube.

In order to assure the smooth upward movement of the additional cymbal on the one hand and to assure the uniform return to the initial position on the other hand, the foot of the outer tube that carries the additional cymbal is guided in a cylindrical tube that surrounds the fixed tube and has at the end an outer flange, which is positioned between two cylindrical springs located in the cylindrical tube. It is understood that both cylindrical springs should be supported on top and bottom in the cylindrical tube, and for that purpose, the cylindrical tube is provided with a cover on both ends. Both cylindrical springs are installed in such a manner as to assure the uniform up and down movement of the cymbal on the supporting outer tube.

The cable tie extends inside a hollow bar or pedal part. Its movement is respectively transmitted to the outer tube through the surrounding part. The invention provides that the cable tie, which is connected to the pedal, has its other end connected through a cam plate to the outer tube, the connecting cams being received in a groove of the fixed tube. This arrangement assures that the outer tube is reliably guided in its up and down movement and is prevented from rotating as the connecting cams are received in the groove and maintain the tube position during the up and down movement.

The distance from the additional cymbal to the fixed cymbal can be preferably varied by making the outer tube as a telescopic tube, which has an end piece on the cymbal to adjust the distance from the additional cymbal to the fixed cymbal and which has an appropriate clamp. The outer tube in this case is made of two parts in the upper area, i.e., in the zone of the end piece, the two parts being movable in each other and connectable by the clamp so that they are attached to the tube that controls the additional cymbal in order to move it.

The distance from the fixed cymbal can also be varied according to the invention by making the fixed pipe on the site of the cymbal infinitely telescopic. In this case an additional device such as a clamp is provided to assure the relative movement of both parts of the fixed tube in each other and to fix them to each other.

The pressure that is built by the cylindrical springs on the up and down moving outer tube can also be changed according to the invention, by the fact that the cylindrical tube that receives the cylindrical springs is connected to a retainer through a threaded joint to preload the springs. Depending on the amount at which the cylindrical tube is run on the threads of the retainer, the pressure increases, and the force needed to move the outer tube will also increase. In any case, it will be understood that the springs are sized in such a manner that they must only assure the return and the accurate guiding of the outer tube.

According to the invention, it is also provided that the movement of the additional cymbal can also be changed, e.g., in such a manner that it will move in the same direction with the upper cymbal. According to the invention, this is achieved by the fact that the pedal part of the bar is coupled directly to the outer tube through a cam drive plate. In this case, the reversal of movement of the pedal is neutralized because the bar and the outer tube are connected to each other, which also allows for the same movement direction. In this case, it is necessary that the cable tie be so elastic as not to be overloaded and broken.

More specifically, overload and breakage are prevented by the fact that the cable tie has a spring device that has its spring rate that is higher than that of the cylindrical springs. In this case, when the outer tube moves under pressure of the cylindrical springs, the spring device assures elongation of the cable tie, thus ruling out damage. The length and design of the spring device can meet certain requirements, and it is only necessary that the desired flexibility be imparted by means of the spring device, which prevents the cable from being damaged.

In another embodiment of the present invention, the above-described mechanical device is made with a pneumatic arrangement described below, wherein the switching between the up and down movement of the bar relative to the outer tube is assured pneumatically. In this case, according to the invention, the bar is provided with a piston, and the fixed tube is made as a cylinder having a top cylinder space and a bottom cylinder space. When the movable bar is moved down by the pedal inside the fixed tube, the outer tube with the lower cymbal that is attached to it must move up to move it to the fixed cymbal, and it is necessary to switch, which is done by the fact that, first, the piston that is movable in the cylinder moves down when the pedal is operated to form a pressure cushion. This pressure cushion is displaced into a so-called air chamber through outlets. The air cushion can only go this way when it is under the bottom of the cylinder. The resulting pressure increases with an increase in speed, whereby the outer tube with the lower cymbal that is attached to it moves up until the lower cymbal strikes the fixed cymbal. Instead of the above-described air cushion, a liquid can be used.

It is advantageous that the cylinder space that is located under the piston be sealed off with respect to the atmosphere and communicate through an outlet with a lower air chamber, which is provided between the outer wall of the fixed tube and the movable outer tube, and its outlet assures a connection to the lower air chamber. It is understood that the movement of the air cushions in the adjacent chambers is only possible if they have sufficient sealing with respect to the other chambers and to the outside air. This is only possible when the air moves along the predetermined path for the desired effect, first for the upward movement and then for the downward movement of the outer tube. Eventual connections to the outside air rule this out because the air will move through such holes along the path of the lowest resistance.

When the outer tube operated by operating the pedal moves up, a face is further provided, upon which the air cushion acts so that the outer tube moves up. This is due to the fact that the outer tube forms an air chamber defined by a ring piston. The ring piston is located on the inner wall of the outer tube and is positively connected thereto. The ring piston can be machined during fabrication of the outer tube, or it can be welded, threaded or by any other means connected later to the outer tube. It is used for assuring the movement of the outer tube as described above when the upper cymbal is caused to move down.

According to the invention, the upper cylinder space communicates with the atmosphere through the holes. When the piston moves down, the air flows to the upper cylinder space through the holes. If this is not the case, the piston can be moved down only under an enormous force. In the hi-hat according to the invention, this is exactly what is required in order to use the three-cymbal instrument as a two-cymbal instrument. When the pedal is released, the whole system should return to its initial position, and, more specifically, the piston should move further up. This is only possible if the openings are provided according to the invention between the cylinder spaces and the atmosphere, and the piston can displace the air that is present in the upper cylinder space to the outside practically without any resistance.

The air will also be displaced from the lower cylinder space into the lower air chamber, and the outer tube releases this pressure by retreating up. The air that is present in the upper air chamber cannot, however, escape, and it will be compressed, thus providing the desired spring effect.

This can be controlled because the ring piston divides the interior space between the fixed tube and the movable outer tube into a lower air chamber and an upper air chamber sealed off with respect to each other, and because a valve is provided in the outer wall of the upper air chamber, whereby the air cushion thus formed is maintained since the valve is designed and adjusted to open when a predetermined pressure is reached. When the pedal is released, the air that is present in the air chamber tends to expand and to exert pressure against the ring piston downwards, and the air in the lower air chamber is thus further displaced through the holes into the lower cylinder space. This allows the instrument to return to its initial position.

It is further provided that the lower cymbal and the outer tube, upon operation or release of the operating device, assure the downward movement of the outer tube to the initial position. The dead weight of the cymbals and of the outer tube works by itself or combined with the above-described air effect to return the system to the initial position. In any case, it is guaranteed that when the pedal is released, the movement back to the initial position is assured, and the pedal can be pressed again. This is especially important for high load when the instrument is used for a musical performance, and this is the mandatory requirement for such instruments.

As mentioned before, it is important that the upper and lower air chambers be isolated from each other in order for the air in the upper chamber to be compressed, whereas the pressure in the lower chamber is used to cause the ring piston and also the outer tube with the lower cymbal to move up. For this reason, an annular groove with an O-ring is provided in the outer wall of the fixed tube in the area of the ring piston. The combination of the annular groove and the O-ring assures the relative sealing of both chambers when the ring piston moves.

In another preferred embodiment, a valve for maintaining an air cushion in the air chamber is provided in the outer wall of the lower air chamber. The valve is designed and adjusted to open when a predetermined pressure is reached. By using this valve, the air cushion can be controlled in order to prolong or shorten the movement of the pedal back to the initial position. If an air cushion with high pressure is already present with high pressure in the chamber, the return travel of the pedal must be delayed in such a manner that outer tube will go so high that the lower cymbal strike the middle cymbal will be relatively short. On the contrary, is the air cushion is formed in such a manner that the air can be displaced from the cylinder space into the air chamber, then the travel will be respectively longer. In this case, the valve is adjusted in such a manner that the lower cymbal strikes the middle cymbal against the upper cymbal. The lower cymbal can strike the fixed cymbal simultaneously, before or after the middle cymbal. This allows the acoustic effect to become richer where the modern sound technology cannot be used. Such shifted strikes can be varied at will by the drummer. By adjusting the valve, the control can assure that the lower cymbal will not only strike shortly the middle cymbal, but it will also stay for a moment in this position. Both cymbals can then oscillate in a non-free oscillation mode, which will give a modified muffled sound. There is another advantageous adjustment capability. If the valve is opened, the air that escapes from the cylinder space, and, instead of pushing the outer tube up, this air flows outside through the open valve. The lower cymbal does not work. In this case, the triple hi-hat works like a conventional instrument.

Further, it would be advantageous to use a crossover valve. This valve reacts in both directions, inwardly and outwardly, and it can be adjusted to meet different requirements.

In order to achieve optimum oscillations of the cymbals, and more specifically, of the middle cymbal, which is struck by both the lower cymbal and the upper cymbal, the middle cymbal is undulated in the radial direction. With this configuration, the number, shape and size of the undulations can be a matter of choice, and it is guaranteed that the middle cymbal will not oscillate as a substantial mass even in the case when the strike occurs simultaneously, which is absolutely undesirable because the sound quality would be impaired. This effect is assured because of the pliable and less stiff structure of the cymbal, as well as because of its larger surface area. By changing the middle cymbal, the drummer can realize his "ideal" sound.

When the middle cymbal is shaped in this manner, it is preferred that, in order to assure the optimum strike thereon from above and below, the lower and upper cymbals be made convex and have an exaggerated curvature closer to the outer side, which gives the ideal oscillation conditions with a corresponding improvement of sound.

The hi-hat is subjected to a continuous and high load, which is why all joints of any individual component of the instrument are of great importance. More specifically, the bar is detachably connected to the upper cymbal. This force transmitting connection is assured by a preloaded joint, preferably or of metal or plastic, and in the preferred embodiment, the preloaded joint is adjustable in such a manner that with a looser preload, a good oscillation mode is assured with a reverberating sound, and with a tighter joint, "suppressed" oscillations obtain, with a muffled sound as a result. Moreover, the functioning of the cymbal can be altered or even stopped by loosening it on the bar.

The same result can be obtained if the outer tube in a preferred embodiment is detachably connected to the lower cymbal. This can give alterations to [illegible] in a simple manner.

For providing the above-described air cushions and movement of the outer tube, the bar has an annular groove with a seal under the piston in the area below the lower cylinder space and an annular groove with a seal above the upper cylinder space fore sealing with respect to the cylinder, and the piston is sealed with respect to the inner wall of the fixed tube also by means of an annular groove and a seal.

A similar sealing system is provided under the lower cylinder space in order to seal it off for the above-given reasons with respect to the outside air. With this system, when the piston starts moving down, the air does not escape from the chamber system, but is rather displaced from the lower cylinder space into the lower air chamber through the openings provided for this in the lower air chamber.

The same applies to the area above the upper cylinder space where the annular groove with the seal is provided for isolating the upper cylinder space.

In order to optimize the overflow between the lower cylinder space and the lower air chamber, it is preferred that a plurality of distributed outlets be provided in the periphery of the cylinder, leading to the lower air chamber. It is important that the air be displaced with a very high velocity from one chamber into the other. For this reason, the sections though which the path of the air extends should be as large as possible. In the ideal case, the fixed tube even in the area of the openings is made solid only at points where it is structurally required.

In order to reduce wear and to dispose of unnecessary joints, the bar and the piston are made integral.

The invention is distinguished by the fact that a musical instrument, a hi-hat, is provided which can have various uses and which allows for numerous sound variations for the music without using any additional devices. Moreover, the hi-hat has been transformed into a triple hi-hat, which not only allows an additional cymbal to be installed, but also, when it is necessary, only two cymbals can be used in a conventional manner. In this case, a corresponding joint that is used for mounting the additional lower cymbal is loosened, whereby only the upper cymbal can be moved toward the fixed cymbal to strike it. In practice, however, the three cymbals will be used according to the invention, of which one moves from top down and the other moves from bottom up to strike the middle cymbal. Although they are operated with a single pedal, the musician's capabilities are not restricted because he has appropriate adjustments available so as to alter and control the sound in such a manner as to generate a desired sound sequence. The above-described variety of capabilities will naturally interest an experimentally-inclined musician, and further effects will become available.

Other features and advantages of the invention will become apparent from the following description with reference to the accompanying drawings, which show preferred embodiments with the necessary components and parts and in which:

DETAILED DESCRIPTION

Figure 1:
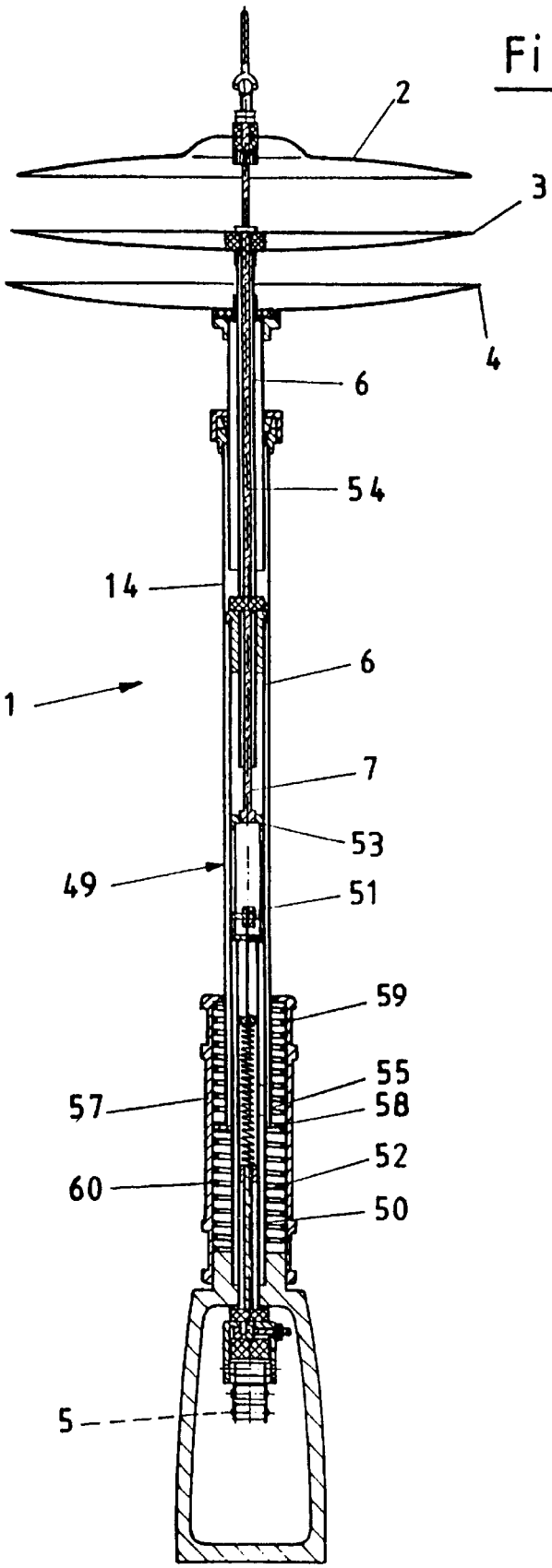
FIG. 1 shows a triple hi-hat, a side elevation, with the support shaft in section.
Figure 2:
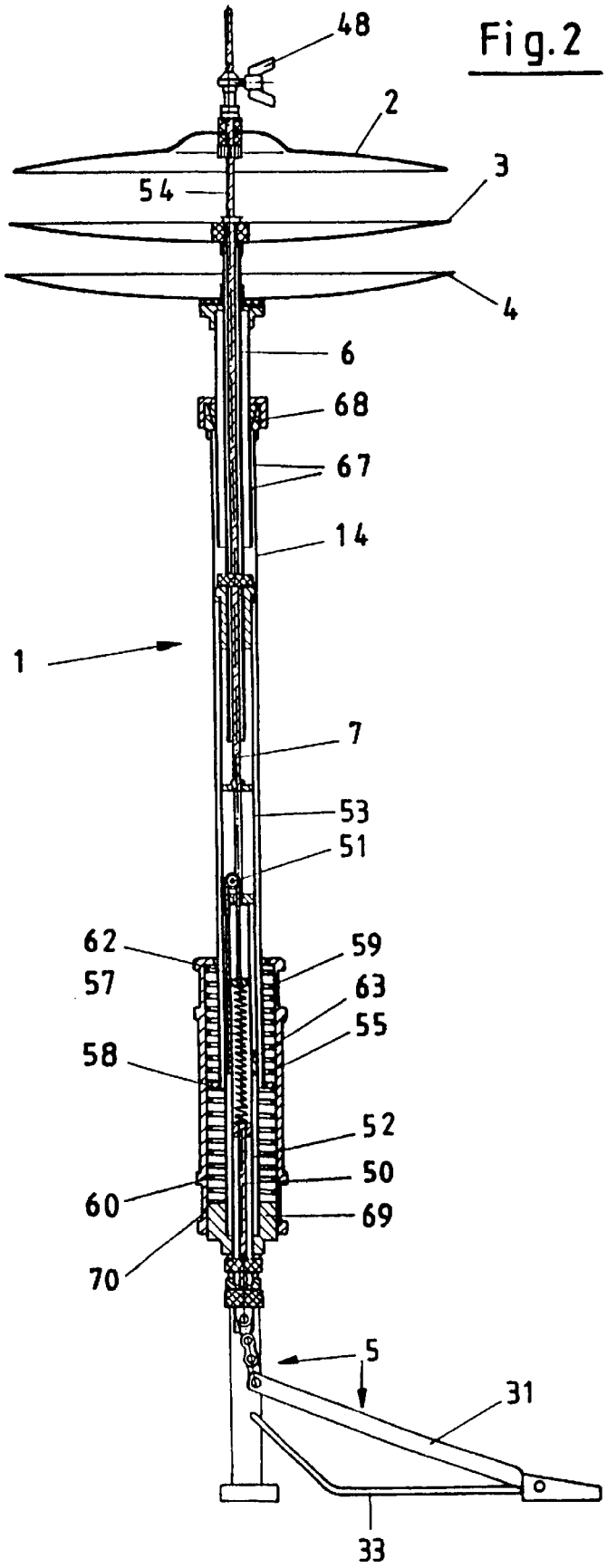
FIG. 2 is the hi-hat of FIG. 1, a side elevation, shown with the pedal.

FIGS. 1 and 2 show a hi-hat 1, which is also referred to as a triple hi-hat because, in addition to a known upper movable cymbal 2 and a fixed cymbal 3, there is provided a lower cymbal 4, which can be caused to move to the fixed cymbal 3 by means of an operating device 5.

The fixed cymbal 3 is attached to the top end of a fixed tube 6, and, although this is a conventional cymbal, it can be struck both from the bottom and from the top.

Figure 3:
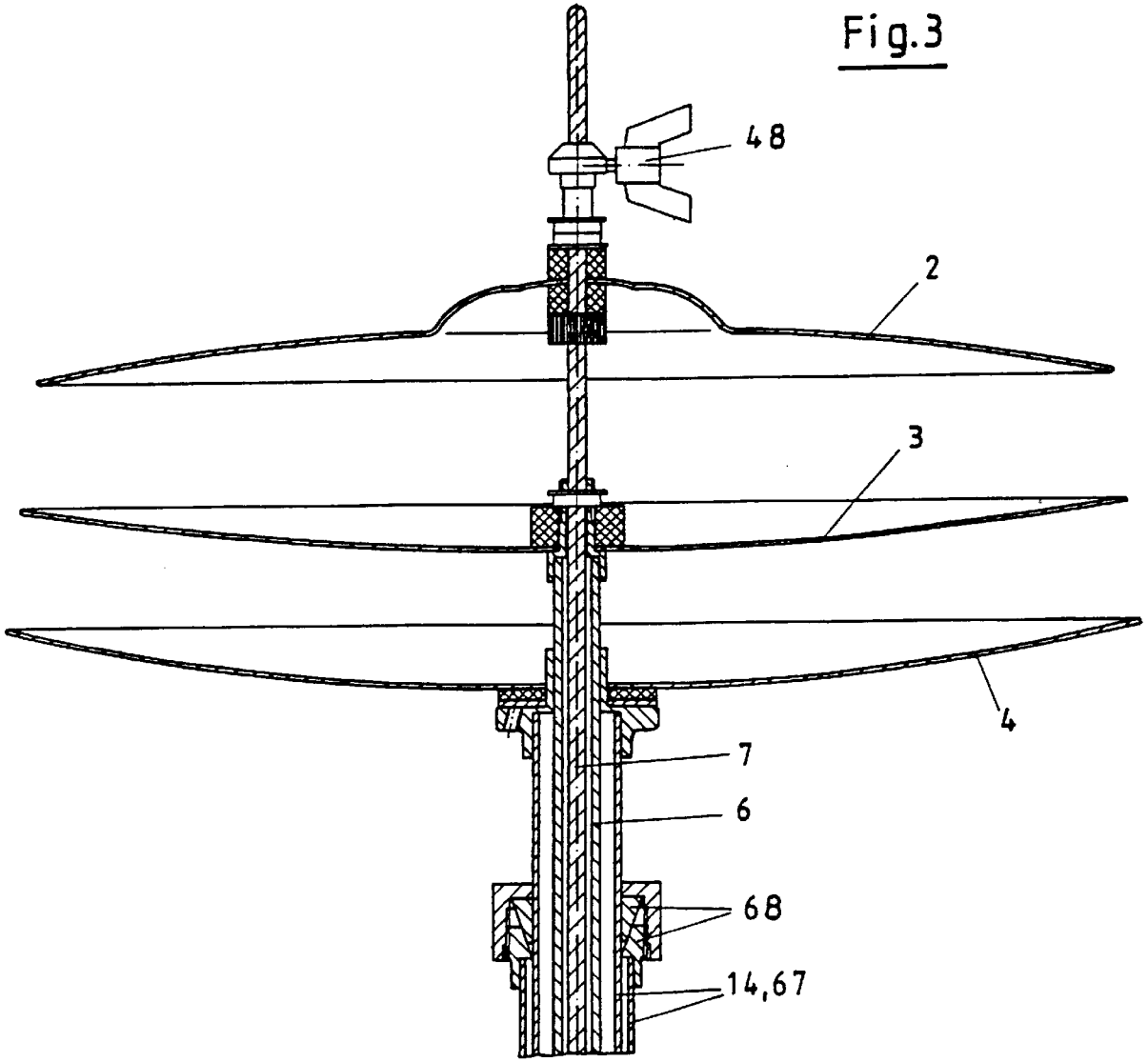
FIG. 3 shows the upper part of the hi-hat with three cymbals.

It can be seen in FIGS. 1, 2 and 3 that the cymbals 2, 3 and 4 which are used have different diameters. More specifically, the lower cymbal is the largest cymbal 4, which has the largest diameter.

The upper cymbal 2 is connected to a bar 7, movable up and down, and the bar 7 is detachably connected to the upper cymbal 2. An appropriate wing screw 48 can be seen.

With the help of the mechanical operating device 5, which is explained with reference to FIGS. 1 through 7, the upper cymbal 2 is caused to move from the top to and to strike the fixed cymbal 3, and the lower cymbal 4 can be moved from underneath towards the fixed cymbal 3. It will be also shown below that it is also possible to cause both movable cymbals to move in the same direction.

A support shaft 49 for the cymbals 2, 3 and 4 has different tubes extending in each other, and the innermost tube, i.e., a tubular bar 7 supports a cable tie 50 on a deflection roller 51 in such a manner that when a pedal 31 move down against the force of a spring 33, an outer tube 14, which is connected to the cable tie 50, moves up. The bar 7 will at the same time move down in the conventional manner, whereby the upper cymbal 2, which is connected to the bar, strikes the fixed cymbal 3.

For supporting the cable tie 50 and the deflection roller 51, the bar 7 is divided into a hollow pedal part 52, a matching hollow sleeve part 53, and a cymbal bar 54, which are connected to each other. This system can be specifically seen in FIGS. 5, 6 and 7. It can be seen in these figures that the cable tie 50 can move concentrically within the pedal part 52, although the cable tie 50 is connected at the other end to a cam disk 63, which connects the tie to the outer tube 14. The cam disk 63 has connecting cams 64 which extend from the pedal part 52 and through the fixed tube 6. The fixed tube has a groove 65 for this purpose.

The outer tube 14 has, in the zone of its foot 55, a flange 58, and this flange 58 is mounted between two cylindrical springs 59 and 60. The cylindrical springs 59, 60 are located in a cylindrical tube 57, which is closed on top and bottom, so the cylindrical springs 59, 60 can be supported. With this arrangement, the foot of the outer tube 14 is guided smoothly when the outer tube 14 moves either up or down. The cylindrical springs 59, 60 serve in both directions to assure the necessary smooth guidance and also to assure the return of the flange 58 together with the outer tube 14 when the foot is removed from the pedal.

The cylindrical springs 59, 60 can be preloaded in such a manner that the cylindrical tube 57 is locked by means of a threaded retainer 69. The cylindrical tube 57 can be moved more or less by means of the retainer 69, thus adjusting the preload of the cylindrical springs 59, 60 as required.

As mentioned above, the upper cymbal is detachably connected by means of the wing screw 48 to the bar 7, more specifically, to the cymbal rod 54. Thus the wing screw 48 allows the distance from the upper cymbal 2 to the fixed cymbal 3 to be adjusted.

The distance from the lower cymbal 4 to the middle cymbal 3, which is stationary, can be adjusted because an end piece 67 of the outer tube 14 is telescopically mounted. Both ends of the outer tube 14 are connected to each other by means of a clamp 68, so the position or the height of the lower cymbal 4 can be adjusted.

Not only can the position of the upper cymbal 2 and the lower cymbal 4 be varied, but also the middle fixed cymbal can be adjusted as well. For that purpose, there is provided a telescopic clamp 75, which ties together both parts of the fixed tubes 6 that can moved inside each other, so the inner fixed tube 6 can be extended from the other tube. This is shown in FIG. 4.

Figure 4:
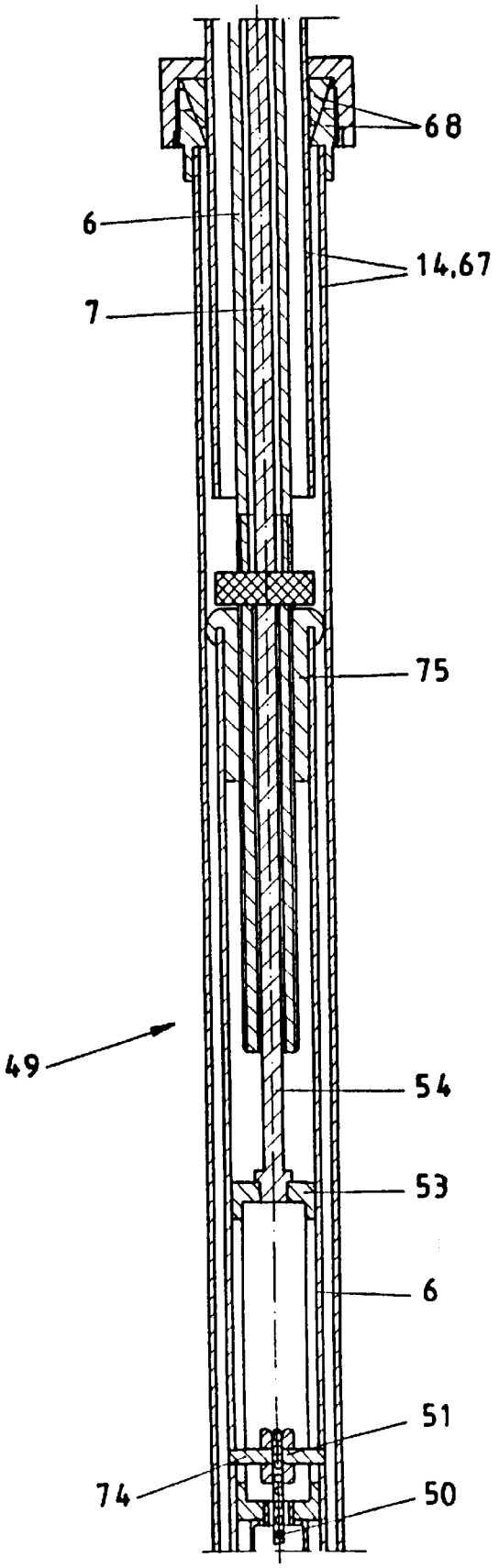
FIG. 4 shows the middle part of the support shaft with a joint between both parts of an outer tube and the fixed tube.

It can also be seen in FIG. 4 that the deflection roller 51 is journalled on an axle 74 of the fixed pipe 6. This assures the reliable guidance of the cable tie 50 when the cable tie moves against the force of the cylindrical spring 59 or 60.

The specific construction of the cymbals 2, 3, 4 has been already described. More specifically, FIG. 3 shows the specific configuration that can be used for the embodiment of the hi-hat, although it does not have any particular bearing on the embodiments described here. Other configurations can be used, e.g., the one that is shown in FIG. 8.

Figure 5:
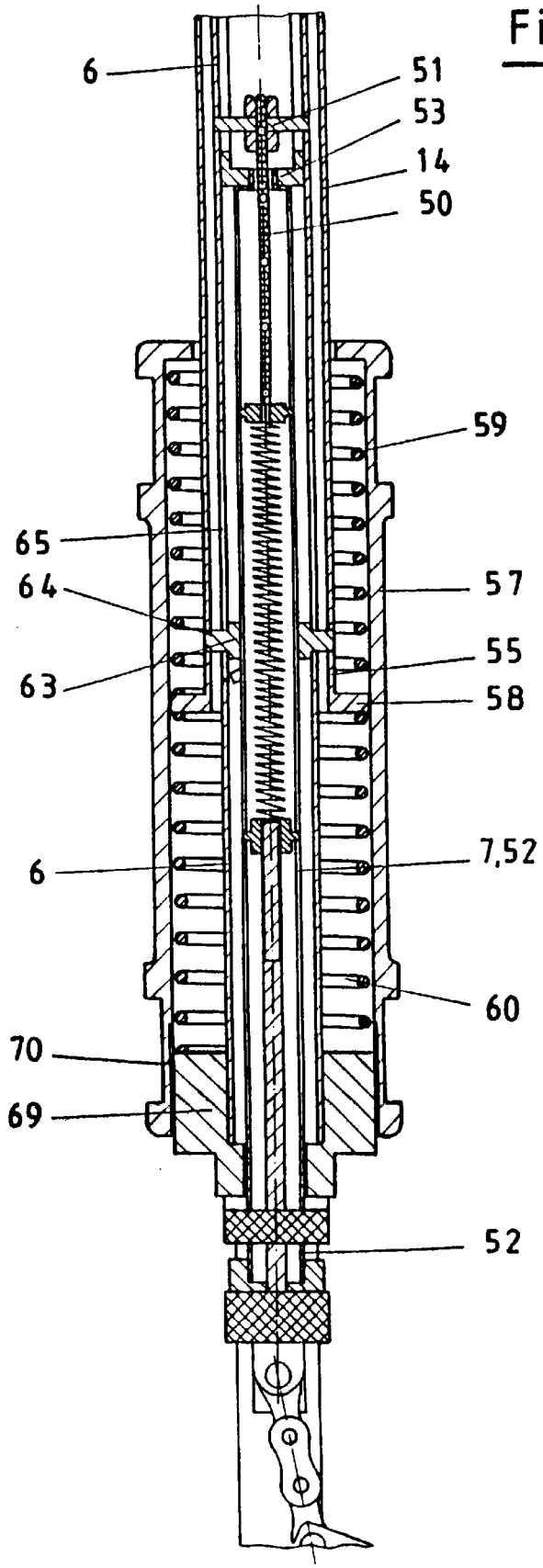
FIG. 5 is a longitudinal section through the lower part of the support shaft, showing a cylindrical tube for cylindrical springs.
Figure 6:
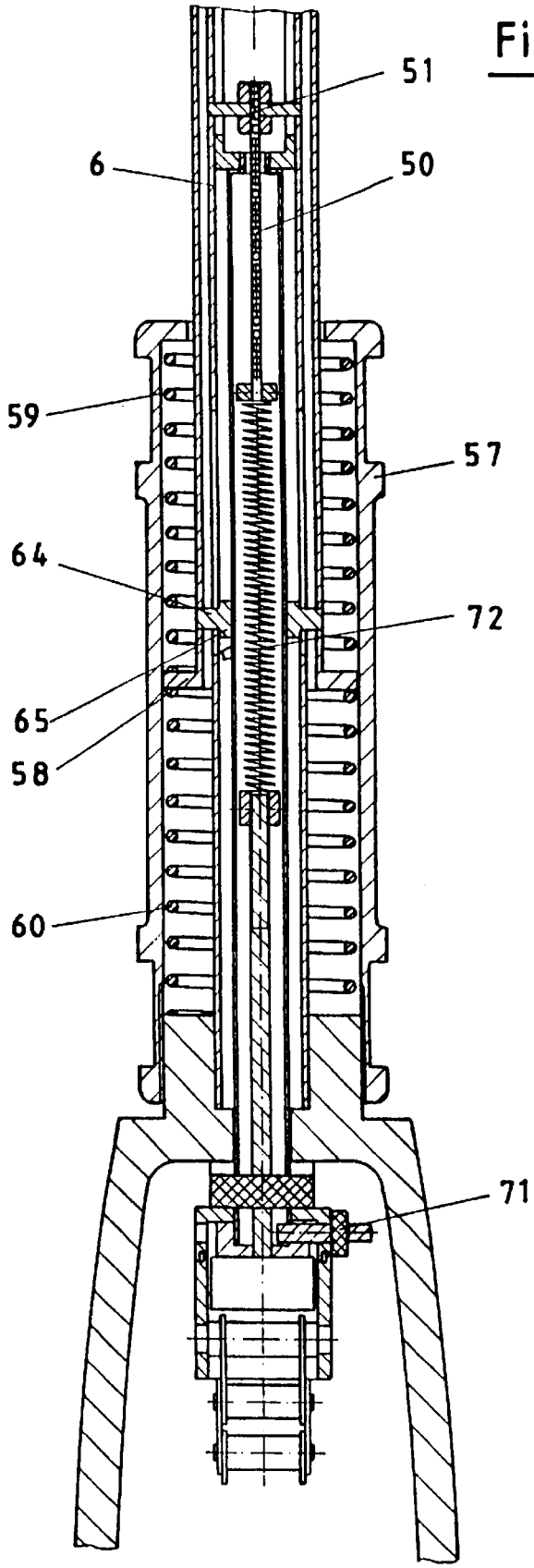
FIG. 6 is a sectional view in FIG. 5, showing an embodiment of a support for the support shaft.
Figure 7:
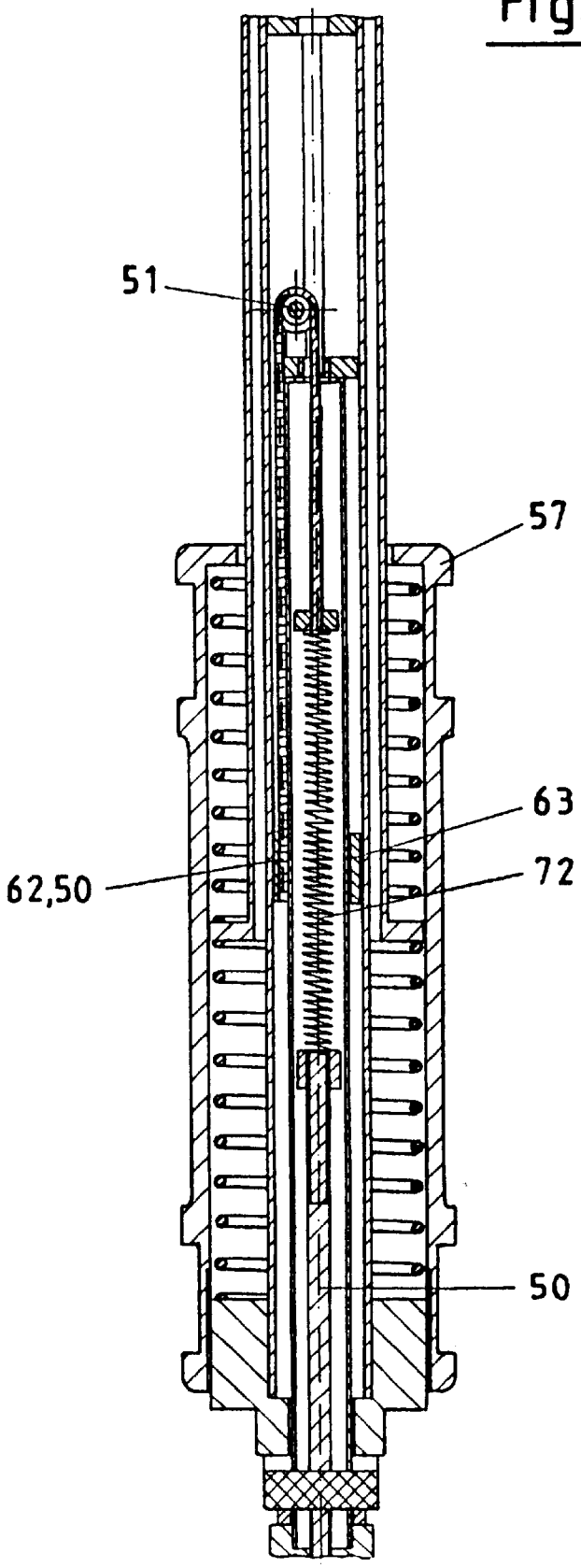
FIG. 7 is a side elevation of FIG. 6.

With the arrangement illustrated in FIGS. 5, 6 and 7, the lower cymbal 4 is moved towards the fixed cymbal 3, and the upper cymbal 2 moves down towards the fixed cymbal 3. If the lower cymbal should move in the same direction as the upper cymbal 2, it can be done by loosening the clamp 68 to move it closer to the fixed cymbal 3 and then connecting directly to the bar 7, to which the cable tie 50 is attached, by means of a cam drive plate 71 and the extending portion of the outer tube 14. With this arrangement, both the additional cymbal 4 and the upper cymbal 2 will move down when the pedal 31 moves down or is pressed. In order to avoid overloading of the cable tie 50, there is provided a spring device 72, with the spring rate of this device being considerably greater than that of the cylindrical springs 59, 60. With this arrangement, the spring device 72 will only protect the cable tie 50 against overload.

Figure 8:
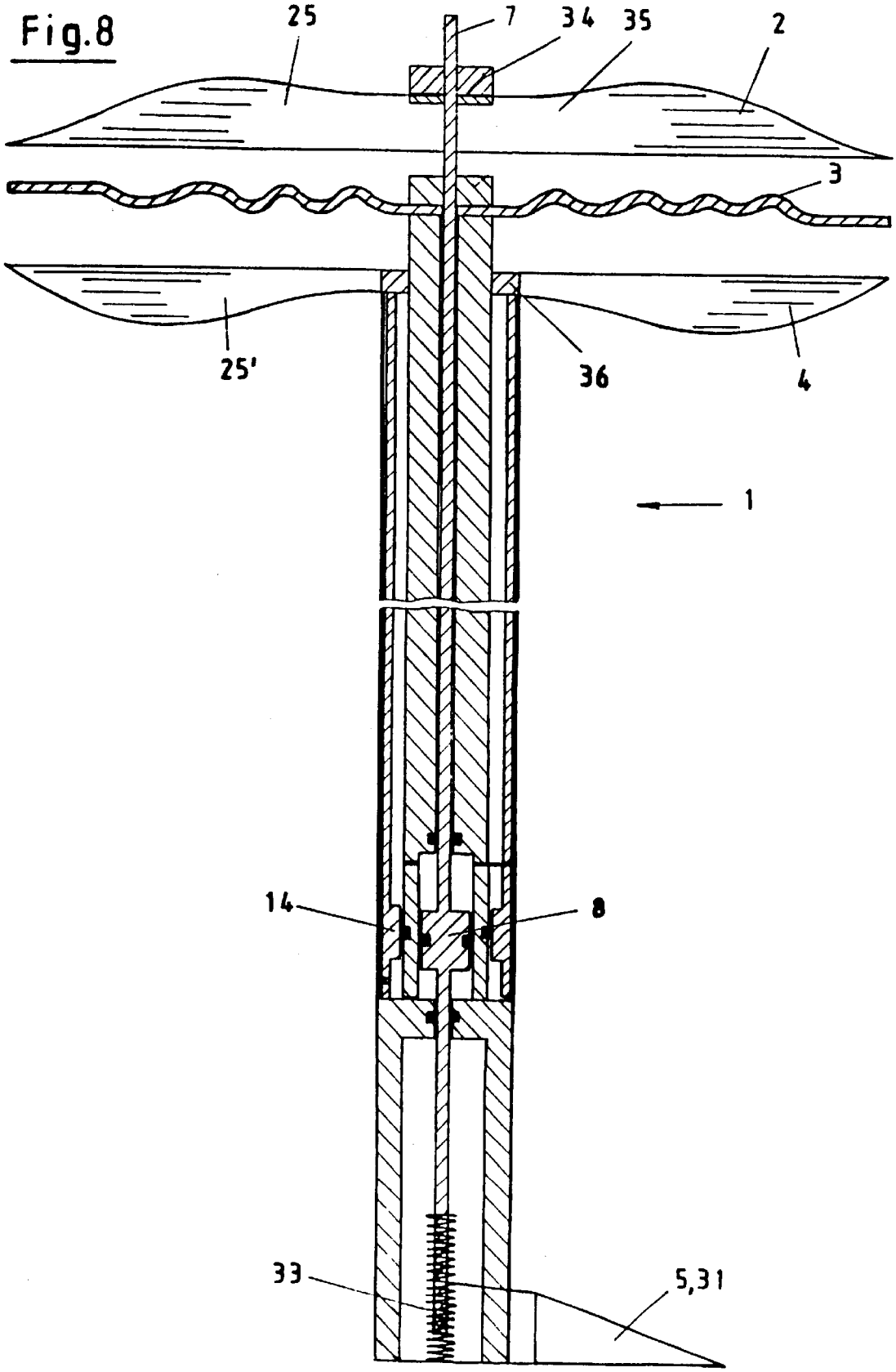
FIG. 8 shows schematically the design of a pneumatic operating device.

FIG. 8 also shows an assembly of the hi-hat 1. This hi-hat 1 is operated by means of the operating device 5, which is normally the pedal 31.

FIG. 1 illustrates an assembly of a triple hi-hat. The instrument is operated by means of the operating device 5, which normally is the pedal 31. This operating device can be used to move together or separately the upper cymbal 2 down and the lower cymbal up. The pedal 3 is connected in a force transmitting relation to the bar 7, which has at its lower end a return spring 33. The return spring 33 is compressed when the pedal 31 is operated and is expanded when the pedal 31 is released. This assures the return of the bar 7 to its initial position, after which it can be caused to move again when the pedal is operated. The bar 7 is surrounded by the fixed tube 6 to which the fixed cymbal 3 is attached. When the pedal 31 is pressed, the upper movable cymbal 2 strikes the fixed middle cymbal 3 to give a desired sound effect. The cymbals 2, 3 are shaped in such a manner that they will always strike each other at their outer rims and have curvature 25, 25' in order to assure the most optimum oscillations of the cymbals 2, 3.

In devices of the prior art, the second or lower cymbal was made convex similarly to the upper cymbal. This is not the case with the triple hi-hat disclosed herein because not only the upper cymbal 2, but also the lower cymbal 4 strikes the middle cymbal 3. In order for this new requirement, more specifically, the requirement to assure optimum oscillation conditions for the middle cymbal 3 in both directions, to be met, the middle cymbal 3 has an undulated shape. Other configurations can also be used, e.g., a planar slightly convex domed configuration or a conventional convex domed configuration of the cymbal. All three cymbals 2, 3, 4 have a central hole. A circular surface is formed in the holes and is configured so that a fastener member 34, 35, 36 can be fitted. The fastener member 34 is used to assure the connection between the upper cymbal 2 and the bar 7, the fastener member 35 is located between the middle cymbal 3 and the fixed tube 6, and the fastener member 36 is located between the hollow tube 16 and the lower cymbal 4. The fastener members 34, 35, 36 are made preferably of metal or plastic and, if possible, are mounted with a preload. With such fastening, the cymbals only in the central part, taking only the smallest possible area of the cymbals 2, 3, 4, are preloaded, and the largest possible area of the cymbal bodies can oscillate freely.

In addition to the upper cymbal 2, the operation of the pedal 31 also causes the lower cymbal 4 (if it is set up in this way) to move towards the middle cymbal 3, which gives an additional sound. This sound can be additionally shifted with respect to the sound generated by the upper cymbal 2.

The functioning of the lower cymbal 4 can be seen in FIG. 2. When the pedal 31 is pressed, the bar 7 goes down with its piston 8. The piston is surrounded by an upper cylinder space 10 and a lower cylinder space 23, and the fixed tube 6, which surrounds the piston 8, defines a cylinder 13. The fixed tube 6 closes the cylinder spaces 10, 23 at top and bottom. In this specific embodiment, the piston 8 and the bar 7 are made integral which is important because of the high dynamic load on the instrument 1.

In the embodiment shown in FIG. 2, the system is in the initial position. Upon the downward movement of the bar 7, when the pedal 31 is pressed, the piston 8, which is sealed by means of an annular groove 42 and an O-ring 43, moves down. The air that is present in the lower cylinder space 23 is displaced by the piston 8 through outlets 9 into a lower air chamber 11, which is defined between the outer wall 15 of the fixed tube 6 and the movable outer tube 14. The outlets 9 are distributed over the periphery of the cylinder 13 and serve as overflow spaces, which should assure a good connection between the lower cylinder space 23 and the lower air chamber 11.

In order for the lower cymbal 4 to be able to strike the middle cymbal 3, the outer tube 14, to which the lower cymbal 4 is attached, is movable. The air that is displaced from the lower cylinder space 23 causes the outer tube to move only down. The condition for this movement is a sufficiently large annular face 21 of a ring piston 20 upon which the air is acting. With this arrangement, the force can be reversed, and the downward movement of the bar 7 and piston 8 results in an upward movement of the outer tube 14, with the consequence that the lower cymbal 4 strikes the middle cymbal 3. In order to avoid underpressure, the inner wall of the upper cylinder space 10 has a hole 26 which establish communication with the atmosphere. During the downward movement of the piston 8, outside air is drawn into the upper cylinder space 10. The above-mentioned annular face 21 defines the lower face of the ring piston 20, which is in a force transmission connection with the outer tube 14. Also in this case, it is advisable that the outer tube 14 and the ring piston 20 be made integral because of the high dynamic load. The ring piston 20 can also be attached later by means of welding, threading, or other connecting joint to the outer tube 14.

The air in the lower air chamber 11 is controlled by means of a valve 12 provided in the outer wall 18 of the lower air chamber 11. To provide this valve 12, a groove or an elongated hole is made in the outer tube 14 (not shown in the drawing). With this arrangement, the valve 12 remains in this position regardless of the outer tube 14 being in the position that is shown in the drawing or in a different position. This valve allows, for example, the amount of air admitted to the lower air chamber to be controlled to the extent that this air can cause the ring piston 20 and the outer tube 14 to move up. When the valve 12 is closed, a small quantity of air is sufficient to assure the coming together of the cymbals 3, 4 and generation of a sound as a result of the upward movement of the outer tube 14. In this case, the instrument 1 is set up in such a manner that the lower cymbal 4 will strike the middle cymbal 3 substantially earlier than the upper cymbal 2 does. If, on the other hand, the valve 12 is open, more air should be displaced from the lower cylinder space 23 into the lower air chamber 11 until the outer tube 14 starts moving. This adjustment also results in the fact that the lower cymbal will strike the middle cymbal 3 only after the upper cymbal 2. Both sounds will then follow each other in a different order. It will be understood that if the valve 12 is so adjusted that the upper cymbal 2 and the lower cymbal 4 strike the middle cymbal 3 simultaneously, this will result in a substantially richer sound. It is further possible, by opening the valve 12 completely, to turn off the system of the instrument 1 that contains the lower cymbal 4. In this case, the air that is displaced from the lower cylinder space 23 will find its natural way of the lowest resistance through the valve 12 instead of the path that would lead to the upward movement of the ring piston 20.

A valve 37 in an outer wall 44 serves to control the upper air chamber 19. First of all, this serves to control the spring effect that is generated by the air present in the air chamber 19. If the valve 37 is completely shut off, this spring is hard to a certain extent. In this case, the outer tube 14 will go up fast when the pedal 31 is pressed and will then return under the spring effect. The air that is compressed during the upward movement of the outer tube tends to expand and push the outer tube 14 back to the initial position. The greater the opening of the valve 37, the weaker this spring effect.

The upper air chamber 19 is located above the ring piston 20. The upper and lower air chambers are sealed off with respect to each other by means of an annular groove 24 and an O-ring 22. The air that is present in the upper air chamber 19 is compressed during the upward movement of the ring piston 20 until the spring effect occurs. The air tends to expand, and the ring piston 20 goes down even more together with the outer tube 14. This results in the air that is present in the lower air chamber 11 being displaced through the holes back into the lower cylinder space 23. This air presses, jointly with the force of the released return spring 33, against the bar 7. This initiates the upward movement of the piston 8 and also the return of the instrument 1 to the initial position. It should be noted that the lower cymbal 4 and the outer tube 14 are sized to have a dead weight with which the return of the lower cymbal 4 and the outer tube 14 to the initial position is assured when the pedal 31 is operated. The air compression is assured if the piston 8 has at least one O-ring seal.

By using various sealing means, a good sealing off of the system with respect to the ambient air must be achieved. In this embodiment, a system of annular grooves and O-rings is chosen. Thus, the lower sealing of the cylinder space 23 is assured by an annular groove 27 with an O-ring 28, and the upper sealing of the upper cylinder space 10 is assured by an annular groove 38 with an O-ring 39, with the upper air chamber 19 being sealed with an annular groove 40 and an O-ring 41.

Figure 9:
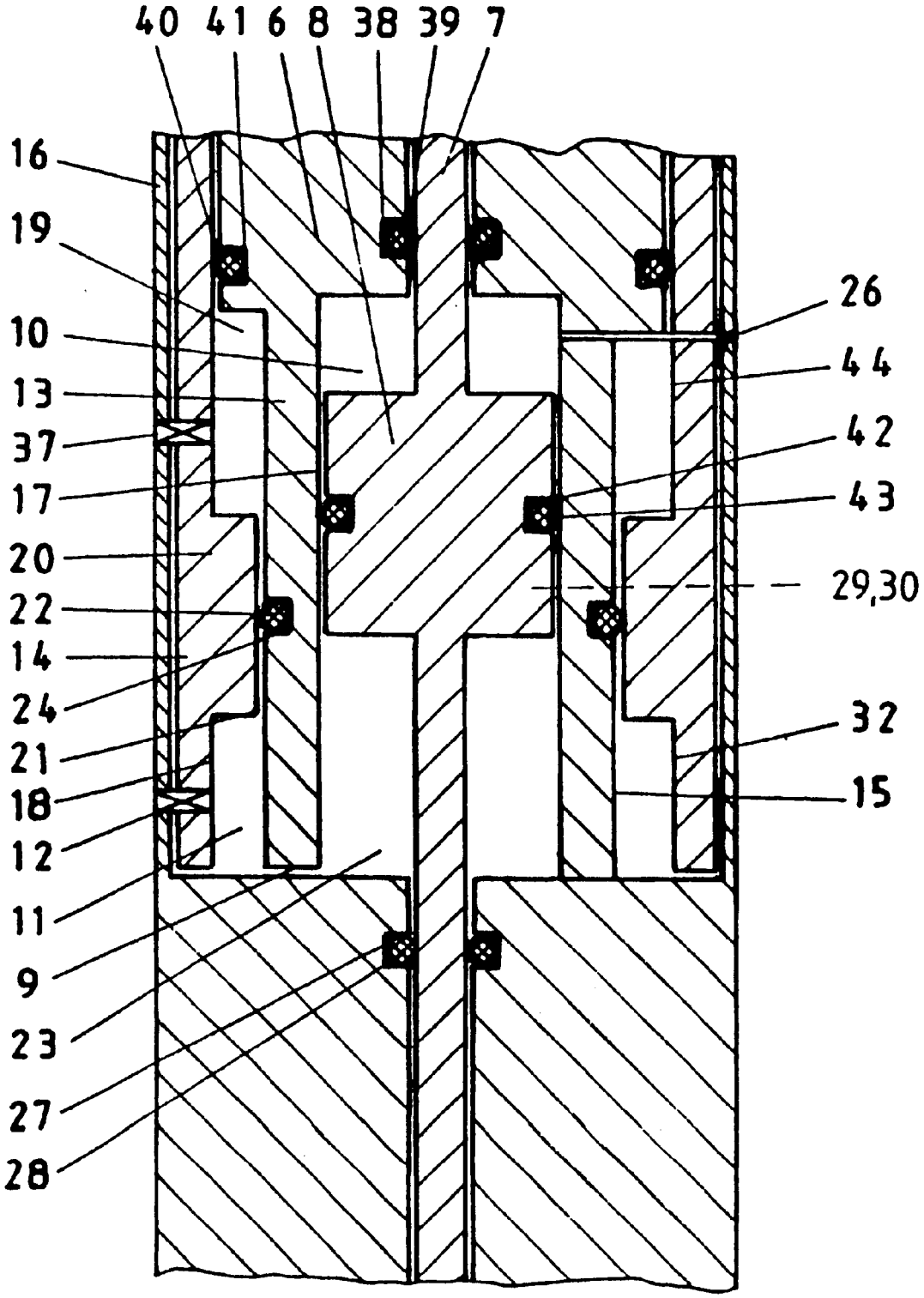
FIG. 9 is an enlarged view of a detail, showing the "pneumatic" parts.

In the embodiment shown in FIGS. 8 and 9, the outer tube 14 is covered with a hollow tubular member 16 to protect against any potential damage. Another annular groove 29 with another O-ring 30 can be used if a single seal 42, 43 cannot cope, e.g., when the piston 8 that is much longer is used. Reference numeral 32 shows the outer wall of the lower air chamber or the outer air chamber, which is filled though the outlets 9 when the pressure is lost.

The invention scope is defined by all the above-mentioned features taken in combination with the drawings.

What is claimed is:

1. Hi-hat apparatus for generating sounds comprising a fixed middle cymbal and an upper cymbal, a fixed tube attached to the fixed middle cymbal and a bar movable up and down attached to the upper cymbal for moving the upper cymbal with respect to the fixed middle cymbal, an operating device operably connected to the bar, a lower cymbal coupled to the operating device for moving up and down to strike the fixed middle cymbal.

2. The apparatus of claim 1, further comprising an outer tube, wherein the lower cymbal is mounted on the outer tube below the fixed middle cymbal and the fixed tube surrounds the outer tube and is coupled to the operating device.

3. The apparatus of claim 2, further comprising a pedal pivotally connected to the bar, a cable tie connected to the outer tube, a deflection roller for guiding the cable tie being attached to the outer tube.

4. The apparatus of claim 3, wherein the bar comprises a pedal part, a sleeve part, and a cymbal bar, the pedal part comprising a tube for supporting the deflection roller and the sleeve comprising an intermediate bar surrounding the deflection roller and being connected to the cymbal bar.

5. The apparatus of claim 4, wherein the outer tube comprises a foot for supporting the lower cymbal, a cylindrical tube for guiding the foot and surrounding the fixed tube, an external flange on an end of the cylindrical tube, two cylindrical springs mounted on the cylindrical tube such that the external flange is positioned between the two cylindrical springs.

6. The apparatus of claim 5, further comprising a cam disk for connecting the cable tie to the pedal and to the outer tube, a groove disposed on the fixed tube and connecting cams on the cam disk receivable in the groove of the fixed tube.

7. The apparatus of claim 2, wherein the outer tube comprises a telescopic tube with an end piece attached to the lower cymbal for adjusting a distance between the fixed middle cymbal and the lower cymbal and a clamp coupled to the telescopic tube.

8. The apparatus of claim 4, further comprising a cam drive plate for directly coupling the pedal part of the bar to the outer tube.

9. The apparatus of claim 5, further comprising a retainer having threads connected to the cylindrical tube, and wherein the springs are preloaded.

10. The apparatus of claim 5, wherein the cable tie comprises a spring device having a spring rate greater than a spring rate of the cylindrical springs.

11. The apparatus of claim 2, wherein the bar forms a piston and the fixed tube forms a cylinder having an upper cylinder space and a lower cylinder space.

12. The apparatus of claim 11, further comprising a first annular groove and a first sealing ring for sealing the bar below the piston and below the lower cylinder space, a second annular groove and a second sealing ring for sealing the bar above the piston and above the cylinder space, and a third annular groove and a third sealing ring for sealing the piston with respect to an inner wall of the fixed tube.

13. The apparatus of claim 11, wherein the bar and the piston are integral.

14. The apparatus of claim 11, further comprising a lower air chamber disposed between an outer wall of the fixed tube and the movable outer tube, wherein the lower cylinder space is sealed off from atmosphere, and an outlet of the lower cylinder space communicates with the lower air chamber.

15. The apparatus of claim 14, further comprising a plurality of outlets connected to the lower air chamber and disposed over a periphery of the cylinder.

16. The apparatus of claim 14, further comprising holes in the upper cylinder space connected to the atmosphere.

17. The apparatus of claim 2, wherein the outer tube comprises a ring piston and an air chamber defined by the ring piston.

18. The apparatus of claim 17, wherein the ring piston divides an interior space between the fixed tube and the outer tube into a lower air chamber and an upper air chamber sealed off with respect to each other.

19. The apparatus of claim 18, further comprising an annular groove and an O-ring in the groove on an outer wall of the fixed tube proximal the ring piston.

20. The apparatus of claim 18, further comprising a valve in an outer wall of the lower air chamber, an air cushion in the air chamber maintained by the valve, and the valve being adapted for opening when a predetermined pressure is reached.

21. The apparatus of claim 18, further comprising a valve in an outer wall of the upper chamber and the valve is adapted for opening when a predetermined pressure is reached.

22. The apparatus of claim 18, wherein the upper cymbal and the outer tube are disposed such that the outer tube moves downward when the operating device is operated or released.

23. The apparatus of claim 1, wherein the fixed tube comprises an infinitely telescopic bar on a side of the fixed middle cymbal.

24. The apparatus of claim 1, wherein the bar is detachably connected to the upper cymbal.

* * * * *